United States Patent [19]

Alverson et al.

[11] Patent Number: 4,884,045

[45] Date of Patent: Nov. 28, 1989

[54] FAST SWITCHING RECIPROCAL FERRITE PHASE SHIFTER

[75] Inventors: William K. Alverson, Dunwoody; James A. Ruller, Decature, both of Ga.

[73] Assignee: Electromagnetic Sciences, Inc., Norcross, Ga.

[21] Appl. No.: 145,112

[22] Filed: Jan. 19, 1988

[51] Int. Cl.[4] ..... H01P 1/195

[52] U.S. Cl. ..... 333/158; 333/24.1

[58] Field of Search ..... 333/24.1, 158

[56] References Cited

U.S. PATENT DOCUMENTS

| | | | |
|---|---|---|---|
| 3,289,111 | 11/1966 | Carr . | |
| 3,411,113 | 11/1968 | Heithaus . | |
| 3,500,460 | 3/1970 | Jones et al. | 333/24.1 X |
| 3,626,335 | 12/1971 | Hord . | |
| 3,982,213 | 9/1976 | Smith et al. . | |
| 4,389,594 | 6/1983 | Conciauro et al. | 333/24.1 X |
| 4,445,098 | 4/1984 | Sharon et al. . | |
| 4,467,292 | 8/1984 | Ajioka et al. . | |

OTHER PUBLICATIONS

Boyd, C. R., Jr., "A Dual-Mode Latching, Reciprocal . . . ", MTT Symposium Digest, 1970, pp. 337-340.

Robers, R. G., "An X-Band Reciprocal Latching Faraday Rotator Phase Shifter", MTT Symposium Digest, 1970, pp. 341-345.

Treuhaft, M. A. and L. M. Silber, "Use of Microwave Ferrite Toroids to Eliminate External Magnets . . . ", Proc. IRE, vol. 46, Aug. 1958, p. 1538.

Scholmann E., "Theoretical Analysis of Twin-Slab Phase Shifters . . . ", MTT-14, Jan. 1967, pp. 15-23.

Albertsen, N. Chr. and Per Skov-madsen, "A Compact Septum Polarizer", IEEE Transaction, MTT, vol. MTT-31, No. 8, Aug. 1982 pp. 654-660.

Chen, Ming Hui and G. N. Tsandoulas, "A Wide-Band Square-Waveguide Array Polarizer", IEEE Transactions AP, May 1973, pp. 289-391.

Davis, D., O. D. Diagiondomenico, J. A. Kempic, "A New Type of Circularly Polarized Antenna Element:", pp. 26-33.

Hogan, C. L., "The Microwave Gyrator", Bell System Tech. J., vol. 31, p. 1, 1952.

*Primary Examiner*—Paul Gensler

*Attorney, Agent, or Firm*—Nixon & Vanderhye

[57] ABSTRACT

A fast switching ferrite phase shifter is disclosed featuring both reciprocal operation and fast switching speeds. Reciprocal operation in transmit and receive modes is achieved by employing two latching, toroidal non-reciprocal phase shifters; one for transmitting and one for receiving. The exemplary embodiment utilizes input and output circulating devices which include a Faraday rotator and septum polarizer for appropriately routing signals through one or the other of the phase shifters depending upon the direction of input signal propagation. The phase shifter achieves fast switching since the latching, toroidal, non-reciprocal phase shifters are transversely magnetized devices and are disposed entirely within a waveguide so that the generated magnetic field is confined entirely within the waveguide. The phase shifters do not intersect the waveguide walls and, thus, during a switching operation, the magnetic field is not switched through conductive waveguide walls. Accordingly, eddy currents are not induced during a switching operation thereby allowing for fast phase changes to be accomplished (which are not limited due to eddy current delays). An embodiment is disclosed wherein forward and reverse propagating signals may be shifted in phase by individually controllable amounts which may be the same or different.

35 Claims, 18 Drawing Sheets

FIG. 15a
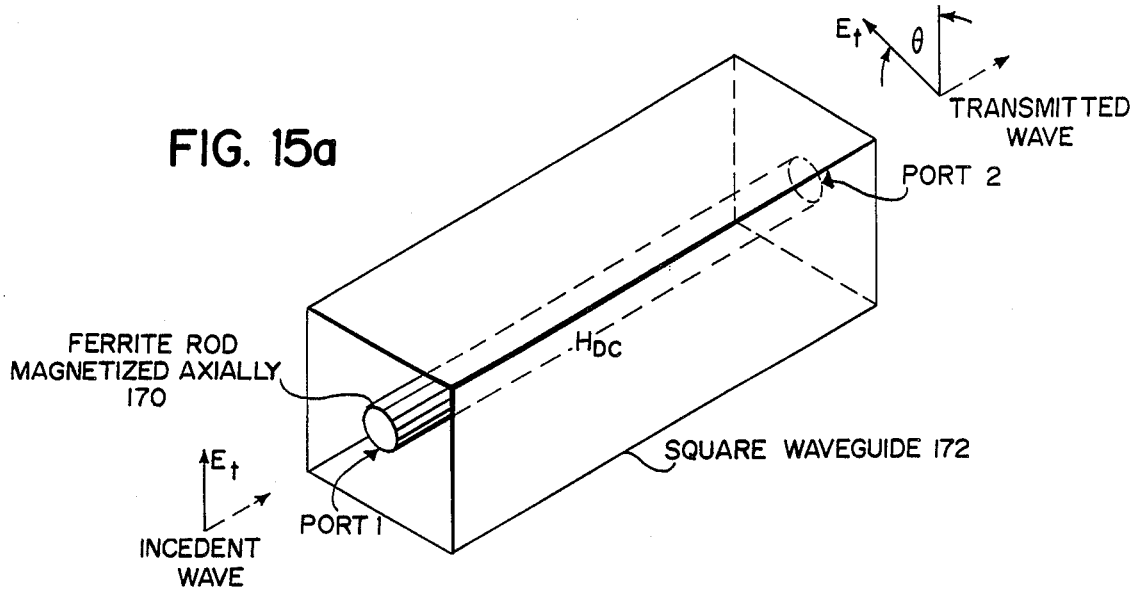
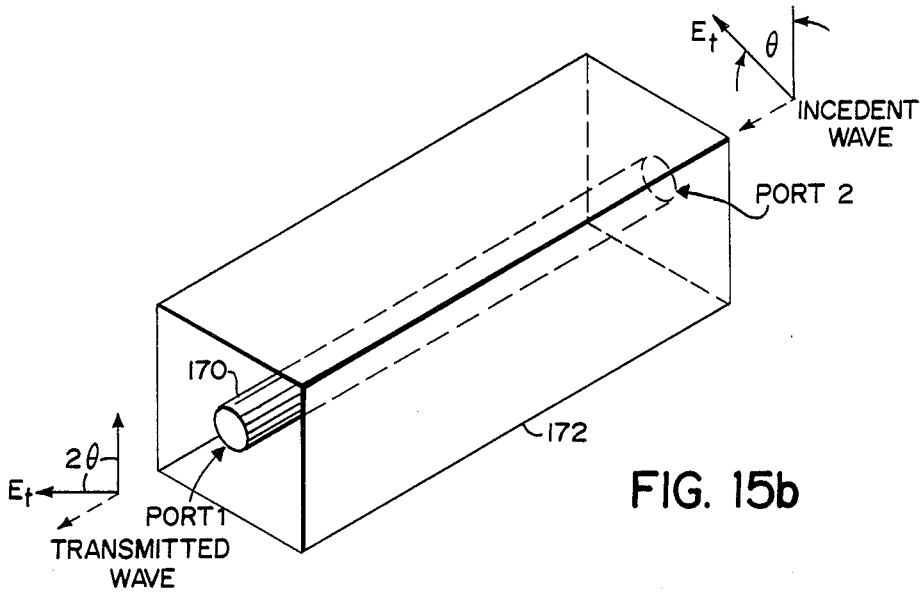
FIG. 15b

FIG. 16b FORWARD PROPAGATION
SECTION A+-A+
SECTION B+-B+
SECTION C+-C+
SECTION D+-D+
SECTION E+-E+
SECTION F+-F+
SECTION G+-G+
SECTION H+-H+
FIG. 16c REVERSE PROPAGATION
SECTION A--A-
SECTION B--B-
SECTION C--C-
SECTION D--D-
SECTION E--E-
SECTION F--F-
SECTION G--G-
SECTION H--H-

FAST SWITCHING RECIPROCAL FERRITE PHASE SHIFTERFIELD OF THE INVENTION

This invention relates to ferrite phase shifters. More particularly, the invention relates to a reciprocal ferrite phase shifter that has the capability of rapidly changing states while providing low loss operation at frequencies in the upper microwave range and while handling high peak and average RF power.

BACKGROUND AND SUMMARY OF THE INVENTION

Microwave phase shifters are used in many applications where it is required to electronically control the transmission of microwave energy either within a system (through a microwave switch) or in free space (in an electronically scanned antenna). These phase shifters typically use either semiconductor (diode) or ferrite technology. Both approaches have various advantages with the diodes generally being superior for lower frequency, low power applications and the ferrite version preferred where high power and/or high frequency conditions are experienced. Both broad classes of phase shifters are presently extensively used in microwave and millimeter systems.

In general, ferrite phase shifters are preferable where high power, low insertion loss (at frequencies as high as X-band), and wide frequency ranges are desired. When one considers phase shifters which are capable of switching in less than 50 to 100 microseconds, only two ferrite devices are widely used: the reciprocal latching phase shifter (dual-mode) and the nonreciprocal twin-slab phase shifter.

Generally, these devices tend to fill separate niches. The twin-slab phase shifter is extensively used in applications where the system requires extremely rapid reconfiguratlon since this unit is capable of changing its setting within 1 to 10 microseconds (that is, 10 to 100 times as fast as the dual-mode phase shifter). The twin-slab phase shifter is, however, inherently a nonreciprocal device and many systems require transmit and receive operations to occur either simultaneously or sequentially within a very short period of time. In these applications, the dual-mode phase shifter is often used since it provides very nearly the same phase shift for both transmit and receive operation without the need for switching (a state change).

In certain applications, such as in radar systems, a need exists for a reciprocal phase shifter (i.e., one which provides substantially the same phase shift for both transmit and receive operations) which also has the capability of switching (i.e., changing state) very rapidly.

In a pulsed radar system, a non-reciprocal phase shifter, in order to operate in transmit and receive modes, must be switched between transmit and receive states. In this regard, such a phase shifter is set in the transmit state to generate a radar pulse, but must be toggled to the receive state in time to receive the pulse returning from a target. If the pulses are transmitted at a high pulse repetition frequency, such a non-reciprocal phase shifter can't be switched at a fast enough rate to receive the returning pulses.

Although the dual mode phase shifter is a reciprocal phase shifter and does not need to be switched between the transmit mode and receive modes, such a phase shifter has significant shortcomings for many radar applications. In this regard, in a system using dual mode phase shifters, a long time is required to change the position to which the antenna is pointing (relative to a system using twin-slab phase shifters). In order to rapidly change the phase front across the antenna, the setting of the phase shifters in the phase array must be changed rapidly. Such dual mode phase shifters thus do not perform optimally in antenna systems where it is desired to move the antenna beam very rapidly. The excess time required to change the antenna position with dual mode phase shifters limits the functions which the antenna system can perform.

The phase shifter of the present invention uniquely provides for both reciprocal operation and fast switching speeds. Reciprocal operation in the transmit and receive modes is achieved by employing two latching, toroidal nonreciprocal phase shifters; one for transmitting and one for receiving. Thus, transmit and receive operations may occur simultaneously without the need for switching phase shifter states. The exemplary embodiment of the present invention utilizes input and output circulating devices which include a Faraday rotator and septum polarizer for appropriately routing signals through one or the other of the phase shifters depending upon the direction of input signal propogation.

The phase shifter of the exemplary embodiment of the present invention also achieves fast switching since the latching, toroidal, nonreciprocal phase shifters are transversely magnetized devices and are disposed entirely within a waveguide so that the generated magnetic field is confined entirely within the waveguide. The ferrite phase shifting elements do not intersect the waveguide walls and, thus, during a switching operation (e.g., when the toroid magnetization state is changed due to application of the latching magnetizing current pulse), the magnetic field is not switched through conductive waveguide walls. Accordingly, eddy currents are not induced during a switching operation thereby allowing for fast phase changes to be accomplished (which are not limited due to eddy current delays). This configuration allows for switching to occur within a time period in the range of 1 to 10 microseconds.

Thus, the present invention provides a phase shifter structure which has properties heretofor unattainable by any prior art ferrite phase shifter, thereby permitting use in applications where prior art ferrite phase shifters cannot perform adequately. At the same time, the present invention has the advantages of existing ferrite phase shifters (as compared to diode phase shifters, i.e., it provides low loss operation at frequencies in the upper microwave and lower millimeter usage and handles high peak and average RF power).

BRIEF DESCRIPTION OF THE DRAWINGS

These as well as other features of this invention will be better appreciated by reading the following description of certain presently utilized phase shifters and the preferred embodiment of the present invention taken in conjunction with the accompanying drawings of which:

FIGS. 7*a* and 7*b* show typical hysteresis loops of a latching twin-phase shifter operating with minor loop switching, wherein FIG. 7*a* shows changing phase states without changing the direction of propagation and FIG. 7*b* shows changing from transmit to receive with the same phase state in both cases;

FIG. 10*b* is an exploded view of the structure shown in FIG. 10*a;*

FIGS. 15*a* and 15*b* show the operation of a Faraday rotator upon incident forward and reverse propagating waves;

DETAILED DESCRIPTION

Prior to describing the details of an exemplary embodiment of the phase shifter of the present invention, a brief discussion is provided of both the dual-mode and twin-slab phase shifters for background information.

Longitudinally Magnetized Dual Mode Phase Shifter

Figure 1:
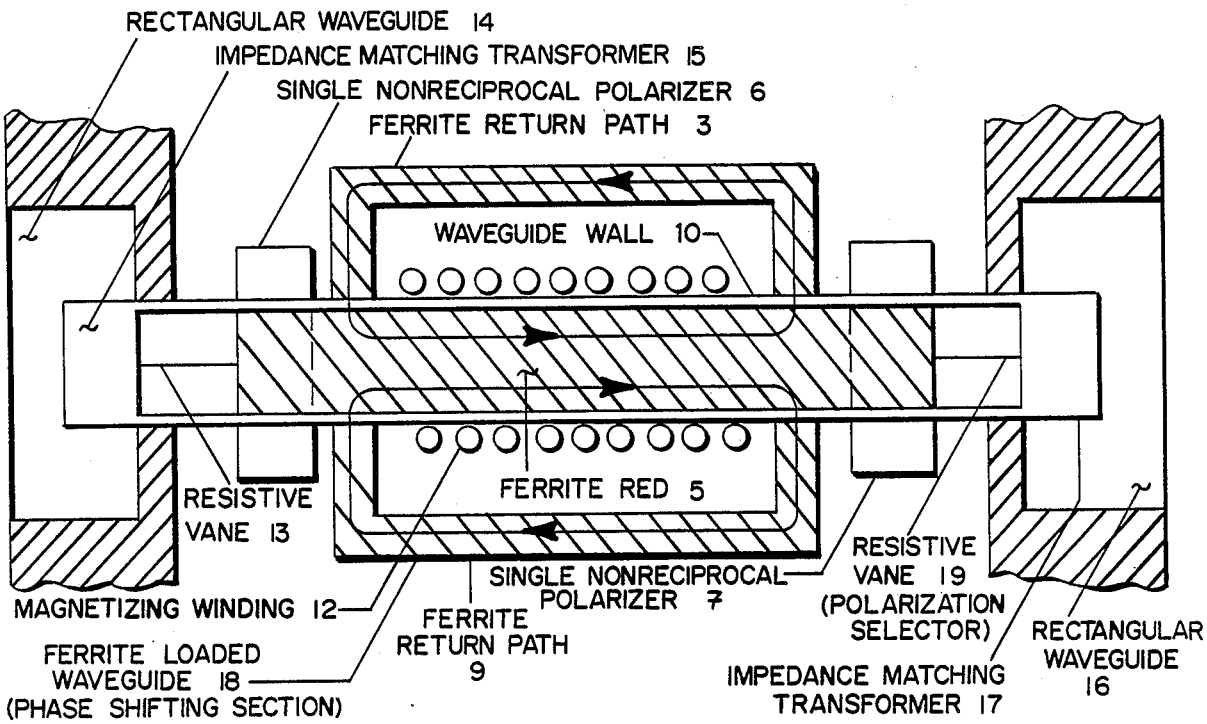
FIG. 1 is across-sectional view of a typical waveguide latching reciprocal (dual-mode) phase shifter.
Figure 2:
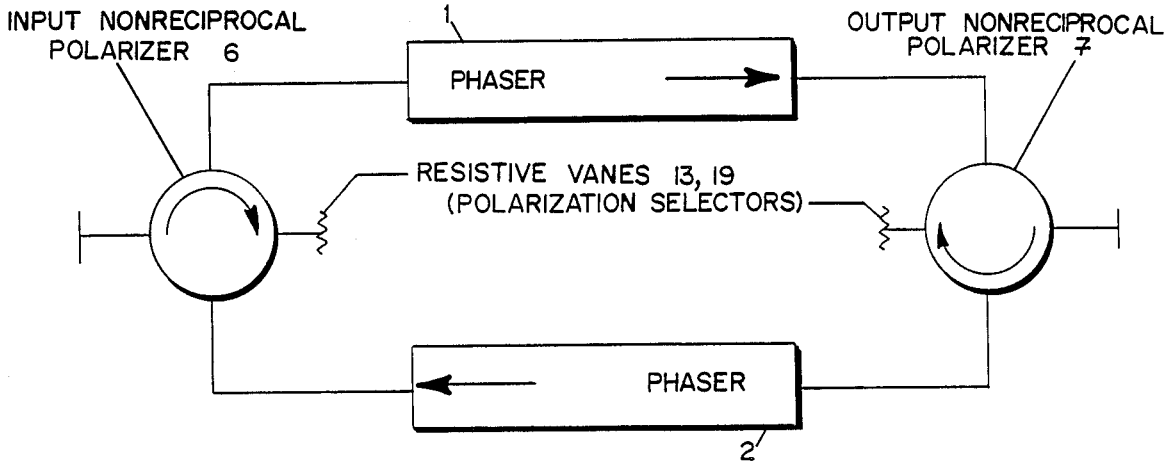
FIG. 2 is an equivalent circuit of the phase shifting structure shown in FIG. 1.

A prior art dual-mode reciprocal latching waveguide phase shifter has the configuration shown in FIG. 1 and the equivalent circuit of FIG. 2. As can be seen in the equivalent circuit, this device achieves reciprocal operation by combining nonreciprocal elements which are represented by phasers 1 and 2 in FIG. 2. The basic phase shifting element is a longitudinally magnetized (via winding 12), fully filled ferrite-loaded waveguide 3 having, typically, either a round or square cross section. Through this rod 5 propagates a circularly polarized wave. The phase shift which that wave experiences depends upon the magnitude and sense of the longitudinal magnetization. The device is made in a "latching" configuration by providing external ferrite return paths 8, 9 outside of the waveguide walls. A composite toroid is thus formed consisting of the ferrite rod 5 through which the microwave energy passes and the external magnetic "yokes" which define the return paths 8, 9. Between these elements is, of course, the waveguide wall 10 which is a thin (perhaps 100 microinches) layer of high conductivity material deposited directly upon the ferrite rod. This conducting layer acts as a shorted turn when switching occurs, considerably lengthening the time required for such an operation. In applications where switching speed is of great importance, it is possible to reduce the thickness of the coating below that required for optimum insertion loss and achieve switching times approaching 50 microseconds for X-band phase shifters.

The central phase shifting section itself is, however, nonreciprocal since the phase shift experienced by a wave of given polarization will depend upon the direction as well as the magnitude of the magnetization (note that a right-hand CP wave propagating from left to right will see a different direction of magnetization from that seen by a wave of the same polarization propagating from right to left). On the other hand, the fact that two orthogonal modes of propagation exist within the structure (corresponding to right- and left-hand circular polarization) allows reciprocal operation to be achieved if a different sense of polarization is launched when entering the rod 5 from the right than from the left. This is accomplished by the single transversely magnetized non-reciprocal circular polarizers 6, 7 shown at either end of the phase shifting section. These polarizers 6, 7 are also sections of fully filled ferrite-loaded waveguide with circular or square cross section, but their magnetic biasing field is transverse (rather than parallel) to the direction of propagation. The operation of these elements is similar to that of a conventional dielectric quarter-wave plate in that linear polarization will be converted to circular polarization and vice versa. The sense of linear polarization (or circular polarization) launched depends, however, upon the direction of propagation. These quarter-wave plates function as the 4-port circulators shown in FIG. 2 with the fourth (terminated) port being a resistive vane element 18, 19 at the linear polarized end of the structure oriented to absorb any cross-polarized waves emerging from the unit.

The operation of the dual-mode phase shifter is as described below:

1. RF energy, linearly polarized, is converted to either right- or left-hand (depending upon whether the phase shifter is entered via waveguide 14 and impedance matching transformer 15 or from waveguide 16 and impedance matching transformer 17) circular polarization by means of the non-reciprocal polarizers 6 or 7.
2. The phase of the circularly polarized signal is varied by varying the magnetization of the composite phase shifting toroid.
3. The circularly polarized energy is reconverted to linear polarization by a second non-reciprocal polarizer 7 (or 6) at the output.

4. The resistive vane 19 (or 18) absorbs any undesired orthogonally polarized component at the output.

Operation from right to left is identical with that from left to right except that the opposite sense of circular polarization is launched to assure reciprocal operation.

A variation in phase shift produced is obtained by varying the magnetization of the ferrite-loaded waveguide 3. Since this phase shifting section (in conjunction with the external return path) forms a toroidal structure, the unit may be set to a remanent magnetic state and no magnetizing current will be required after this state is reached.

Figure 3:
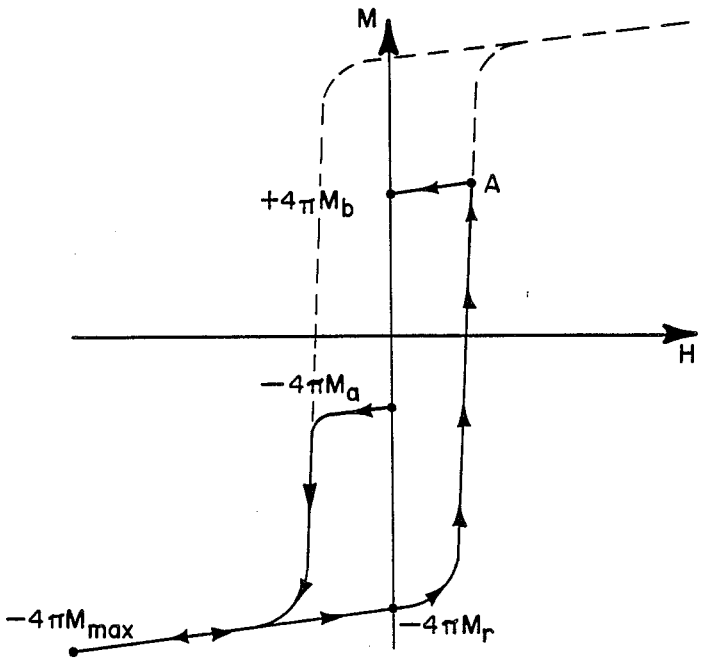
FIG. 3 is a plot illustrating minor loop switching of a dual-mode phase shifter.

Intermediate phase states are achieved by magnetizing the ferrite rod of the phase shifter section 3 to higher or lower states of remanent magnetization as is illustrated in FIG. 3. Here the hysteresis loop formed by the ferrite rod 5 and return paths 8, 9 is presented. At the beginning of a switching operation, the ferrite rod 5 is magnetized at $-4\pi M_a$ (corresponding to phase shift $\Delta\phi$ a to switch to a second magnetization, $4\pi M_b$ corresponding to phase shift $\Delta\phi_b$) the process is as follows. First a saturating current is applied to drive the magnetization of the toroid all the way to the bottom of the loop at $-4\pi M_{max}$; when this current pulse is removed, the magnetization falls to the fully remanent value of $-4\pi M_r$. Subsequently, a precisely controlled magnetizing current pulse is applied which magnetizes the toroid to Point A in FIG. 3 and when this current is removed, the magnetization falls to the minor loop remanent state, $4\pi M_b$. As can be seen, such a switching process allows a continuum of phase states between the maximum values which would be produced at $\pm 4\pi M_r$.

Twin-Slab Phase Shifter

Figure 4A:
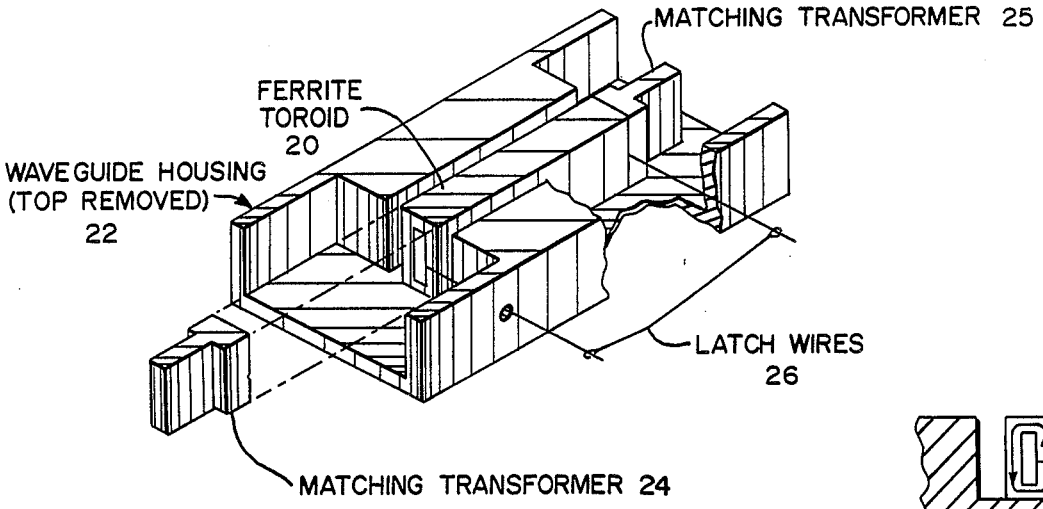
FIGS. 4*a* and 4*b* are single and dual toroid ferrite phase shifters using transversely magnetized toroids.
Figure 4C:
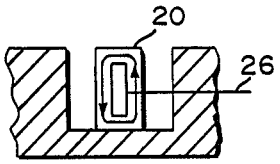
FIGS. 4*c* and 4*d* are diagrams of the latching fields generated with the phase shifters of FIGS. 4*a* and 4*b*, respectively.
Figure 4B:
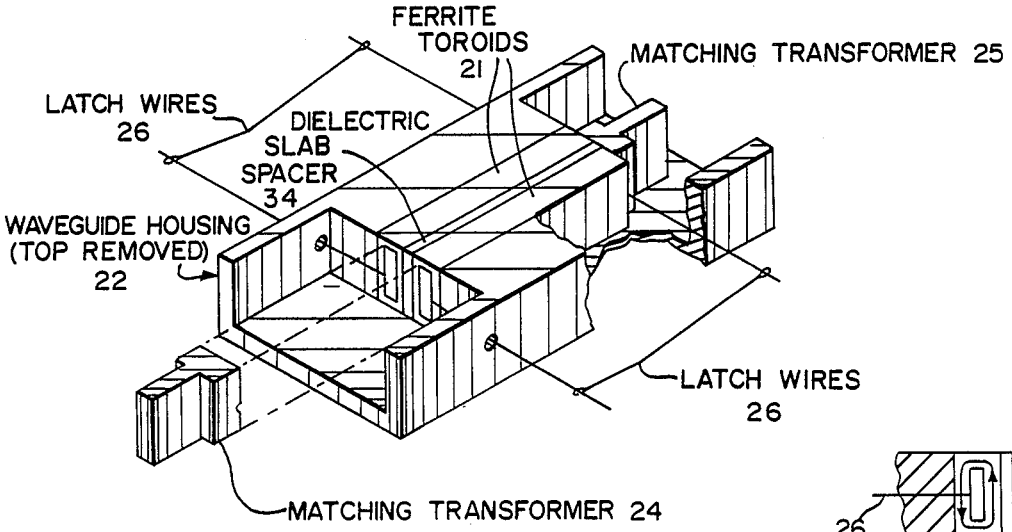

The general construction of the prior art twin-slab phase shifter is illustrated in FIG. 4, with the single-toroid design shown in FIG. 4*a* and the dual toroid design shown in FIG. 4*b*. Corresponding elements in FIGS. 4*a* and 4*b* have been labeled with the same reference numerals.

Figure 4D:
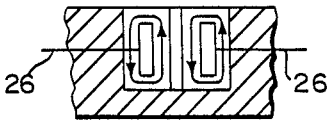

In the twin-slab phase shifter, the ferrite elements 20 and 21 are hollow rectangular cylinders that are placed longitudinally in their respective waveguides 22. Designs using both one and two toroids are common but the dual-toroid design is more common for narrow-band radar applications and for millimeter-wave applications. The single-toroid design has demonstrated the best performance when the requirement is for a frequency independent phase shift over bandwidths exceeding one octave. Each of the phase shifters includes matching transformers 24, 25 and latching wires 26. The dual-toroid shown in FIG. 4*b* includes a dielectric slab 34 between each toroid 21 and a pair of latching wires 26 associated with each toroid. The latching fields for toroids 20 and 21 are shown in FIGS. 4*c* and 4*d*, respectively.

Figure 5:
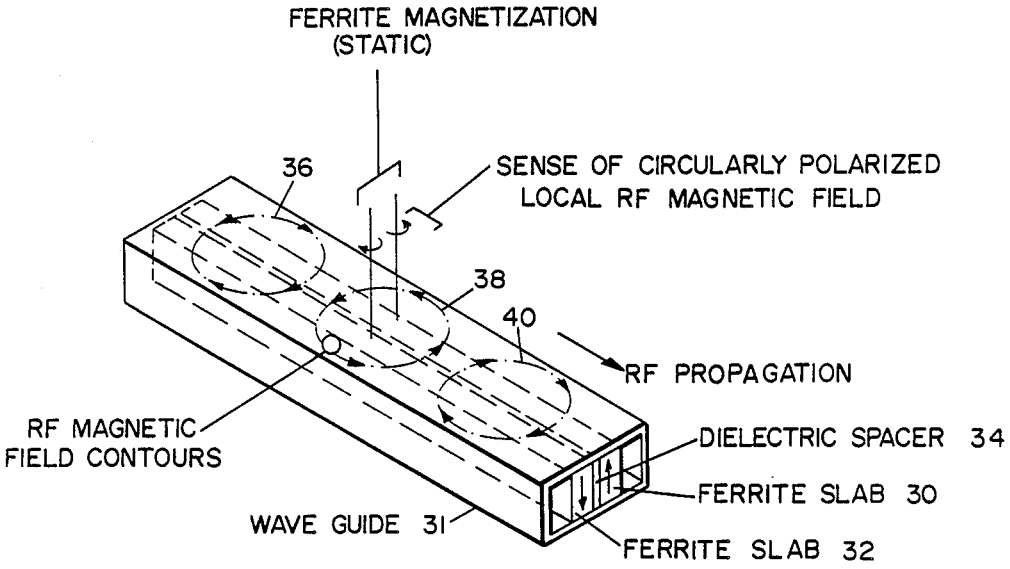
FIG. 5 is a twin-slab phase shifter illustrating magnetic field conditions associated therewith.

The configuration of a generic, twin-slab phase shifter, as illustrated in FIG. 5, consists of two magnetized ferrite slabs 30, 32 that are separated by a thin dielectric spacer 34 in the center of the waveguide 31. The ferrite slabs 30, 32 are magnetized by a static magnetic field that is directed up in one slab and down in the other as shown by the arrows associated therewith. This static bias field may be produced by external magnets, or from "permanent" magnetization of the ferrite. The RF magnetic field associated with the propagating microwave signal is oriented such that the field lines form loops 36, 38, 40 that lie parallel to the broad wall of the waveguide 31. These "loops" 36, 38, 40 move along the waveguide 31 as the signal propagates. Because the direction of the RF magnetic field varies with time, regions exist in the waveguide where the magnetic field is circularly polarized, relative to the vertical direction. With the field alignment as indicated, the microwave signal has the maximum possible sensitivity to the permeability of the ferrite. Therefore, a propagation constant of the microwave signal can be controlled by changing the magnetization of the ferrite.

Figure 6A:
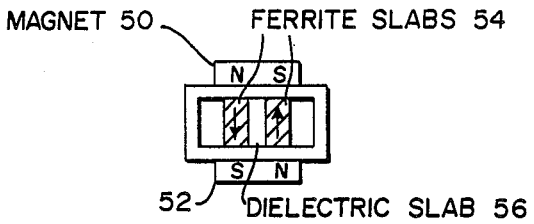
FIGS. 6*a*, 6*b* and 6*c* show three configurations for biasing twin-slab ferrite phase shifters.
Figure 6B:
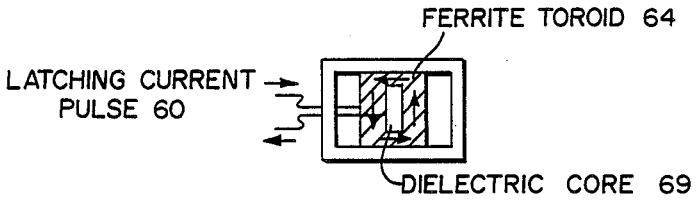
Figure 6C:
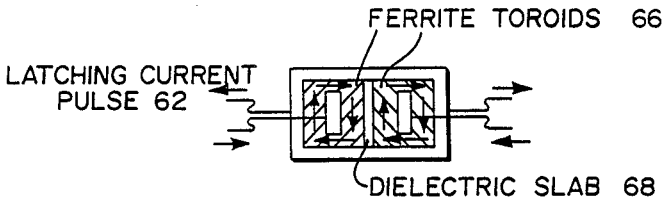

FIG. 6 shows three arrangements for controlling the magnetization of the ferrite. The permanent magnets 50, 52 shown in FIG. 6(*a*) which magnetize ferrite slabs 54 are separated by dielectric 56 and are useful for making fixed phase shifters, such as might be used in four-port circulators. The single- and dual-toroid phase shifters can be "latched" to partially or fully magnetized conditions by passing current pulses 60, 62 through the center of the toroids as shown in FIGS. 6(*b*) and 6(*c*).

The twin-slab phase shifter is inherently nonreciprocal since circular polarization of the RF magnetic field is reversed if the direction of microwave propagation is reversed. "Switched" reciprocal operation can, however, be achieved if the magnetization of the toroidal element is exactly reversed prior to the time at which the reverse propagating signal is applied. The dual toroids shown in FIG. 6(*c*) are separated by a dielectric slab 68 and the single toroid 64 shown in 6(*b*) includes a dielectric core 69.

Figure 7A:
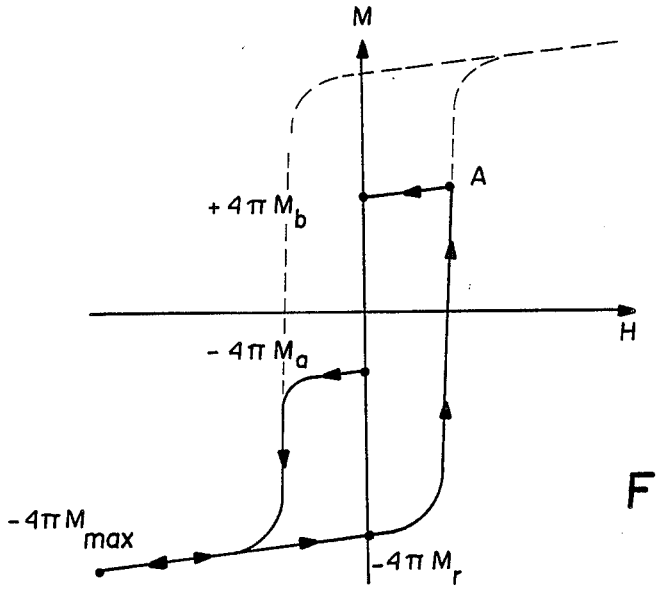
Figure 7B:
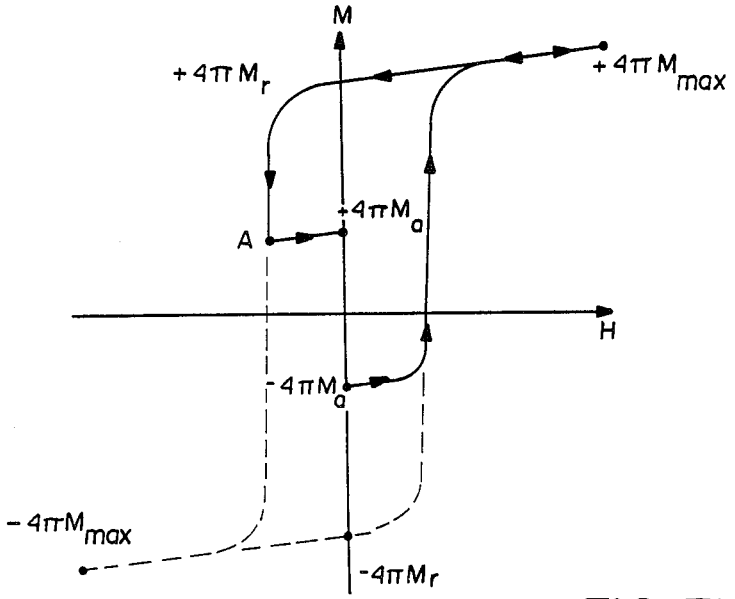

Varying the phase shift produced may be accomplished in the same manner as with the dual-mode phase shifter, i.e., by varying the minor loop state of remanent magnetization to which the toroidal phase shifting element is magnetized. This process is illustrated in FIGS. 7*a* and 7*b*. As can be seen, a two-step switching operation is required with the magnetization first being set into a fully magnetized remanent state at one end of the loop and then to a precisely controlled minor loop remanent state corresponding to the desired phase shift. FIG. 7(*b*) shows the switching operation if switched reciprocity is to be achieved for a reverse propagating signal. As can be seen, the direction of the "reset" and "set" switching operations are exactly reversed from those illustrated in 7(*a*) for forward propagation.

Figure 8:
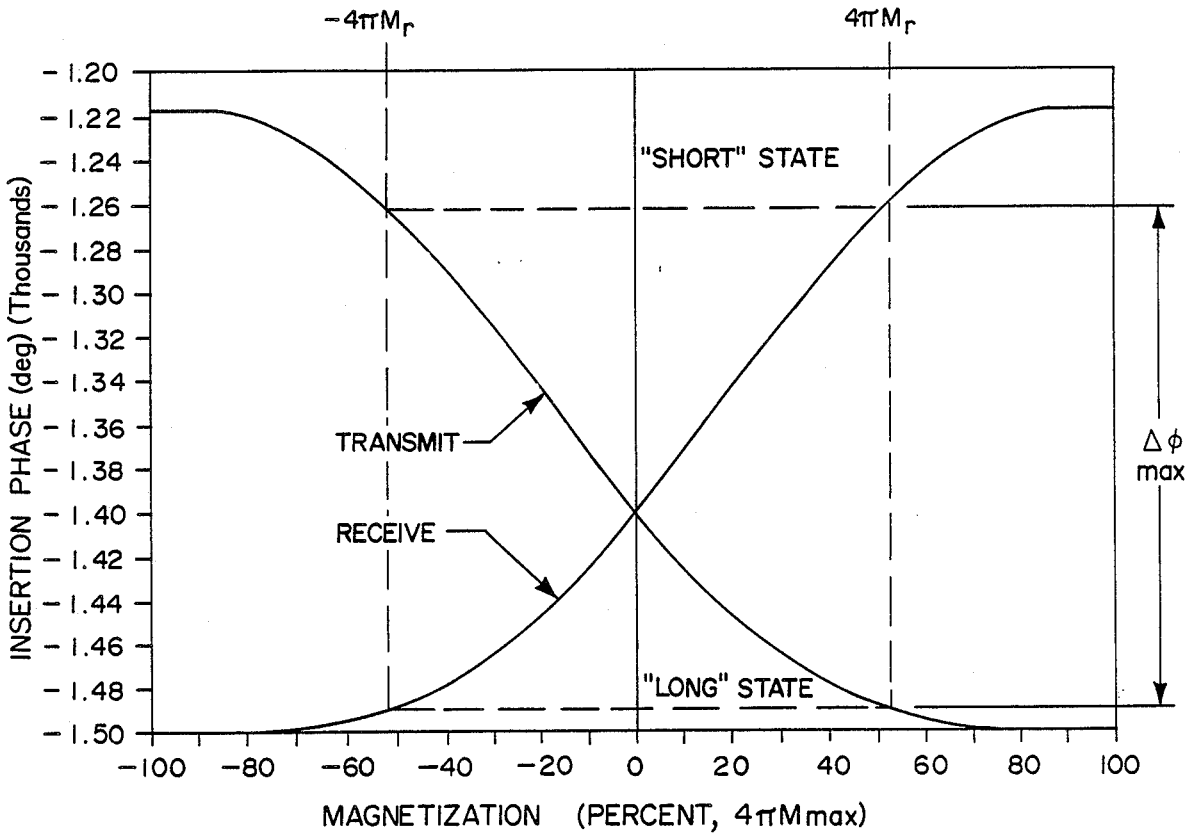
FIG. 8 is a plot of insertion phase versus magnetization of a partially magnetized twin slab phase shifter.

As with the dual-mode phase shifter, the phase shift produced is a monotonically increasing function of the magnetization achieved. FIG. 8 shows the variation of insertion phase with magnetization for a typical twin-slab phase shifter. Curves are presented for both transmit and receive operation in order to further illustrate the concept of "switched" reciprocity. As shown in FIG. 8, as the magnetization is varied from fully magnetized in one direction to fully magnetized in the opposite direction a continuous range of phase states is achieved between maximum and minimum values.

Figure 9:
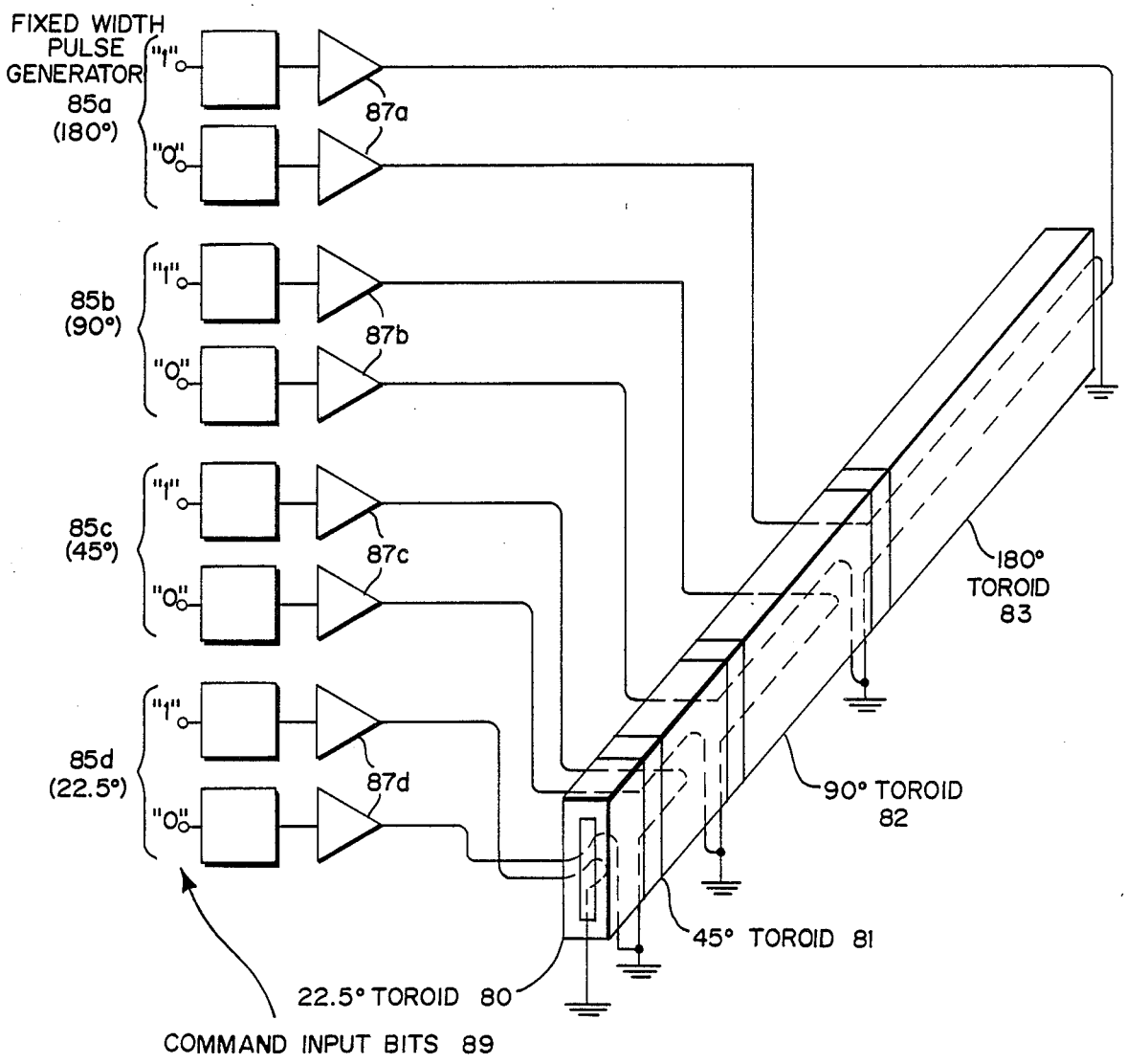
FIG. 9 is a block diagram of a typical electronic driver circuit for a multibit latching twin phase shifter.

A second technique in addition to varying the minor loop remenent states may be used for producing multiple states of phase shift with the twin-slab phase shifter. As shown in FIG. 9, a number of cascaded phase shifting elements are employed each having its own phase shifting toroid(s) 80–83. Toroid element 83 provides 180° phase shift. Each succeeding element 82, 81, 80 provides one half the phase shift of its neighbor (i.e., 90°, 45°, 22.5°). In this case, however, each toroid is latched via pulse generators 85*a*–*d* and associated amplifiers 87*a*–*d* in one direction or the other only to its fully magnetized remanent states ($\pm 4\pi M_r$). A variation of phase shift (quantized to the number of phase shifting sections or "bits" employed) may be obtained by varying the number of command input bits 89 which are sent or reset. In this case, pseudoreciprocal operation can be achieved if each phase shifting bit is set to hhe opposite state of remanent magnetization prior to the arrival of the reversed propagating signal.

THE PREFERRED EXEMPLARY EMBODIMENT

Figure 11:
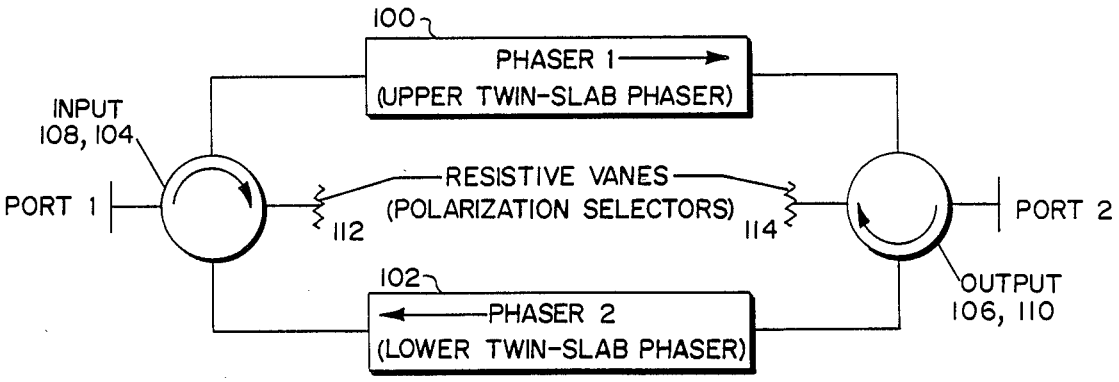
FIG. 11 is an equivalent circuit of the phase shifting structure shown in FIG. 10.
Figure 10A:
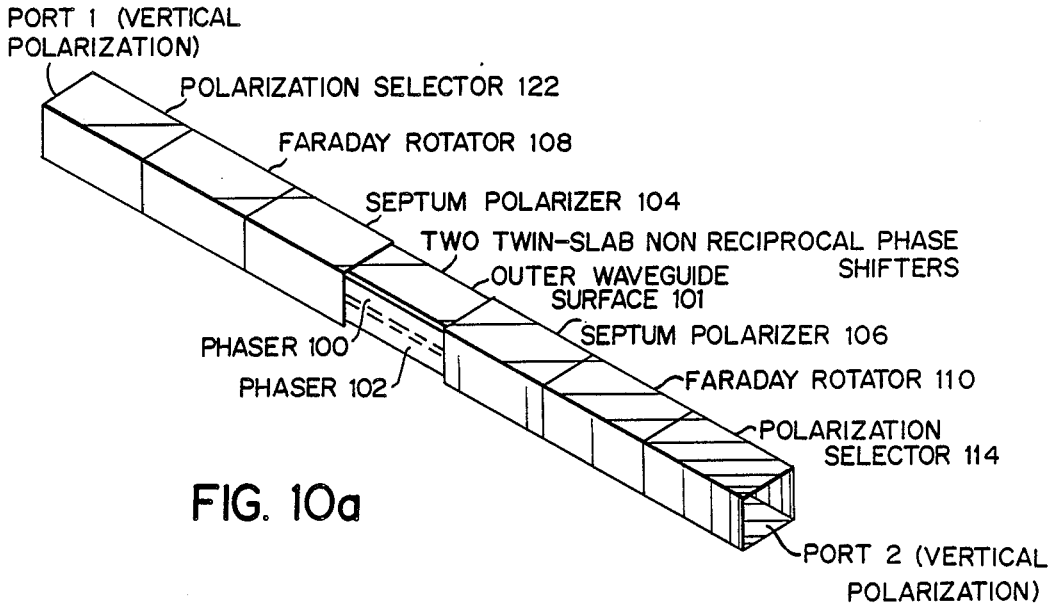
FIGS. 10*a* and 10*b* show the construction of an exemplary embodiment of the fast switching pseudoreciprocal phase shifter of the present invention, where
Figure 10B:
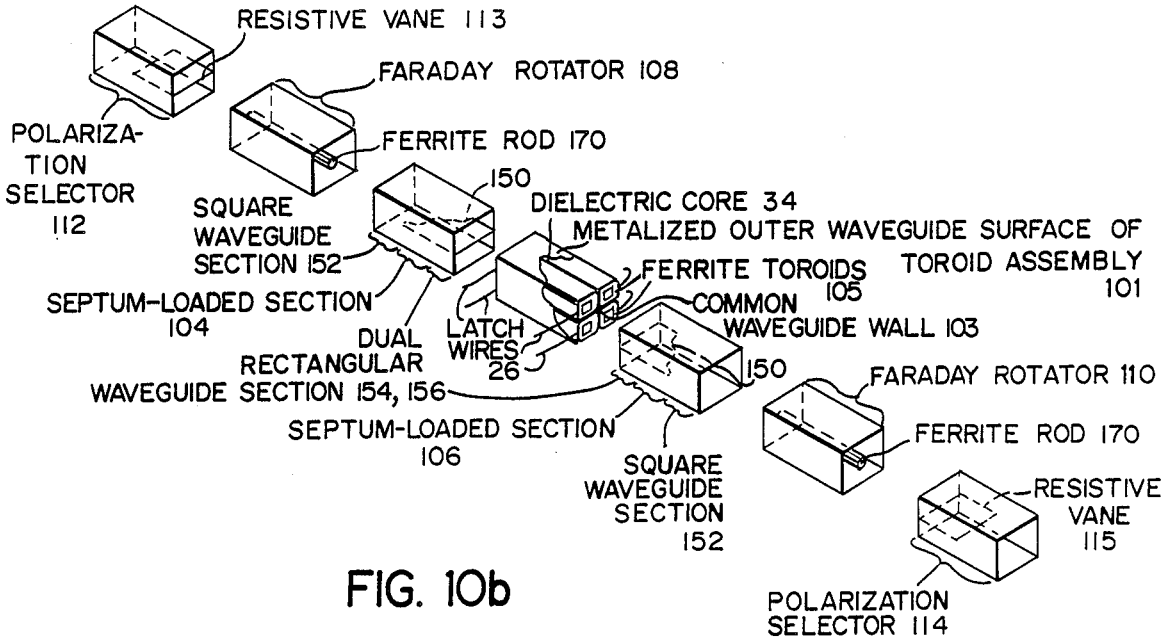

A general realization of an exemplary embodiment of the fast-switching, pseudoreciprocal phase shifter of the present invention is illustrated in FIGS. 10*a* and 10*b*. As can be seen, this unit is comprised of two twin-slab nonreciprocal phase shifters 100, 102, two septum polarizers 104, 106, two Faraday rotators 108, 110, and two absorptive vane polarization selectors 112, 114. An equivalent circuit of this device is shown in FIG. 11. Although the equivalent circuit is represented as being similar to that of the dual-mode phase shifter which was presented earlier in FIG. 2, the exemplary embodiment is significantly different from the dual-mode phase shifter.

In contrast to the dual-mode phase shifter, the phase shifters 100, 102 employed (the twin-slab nonreciprocal phase shifters) in the exemplary embodiment which share common waveguide wall 103 are transversely magnetized toroidal phase shifter elements 105 contained entirely within an enclosing rectangular waveguide 101. Since the toroidal elements (unlike those in the dual-mode phase shifter) do not intersect the waveguide walls, eddy currents are not induced during a switching operation allowing much faster phase changes to be accomplished.

Additionally, in contrast to the dual-mode phase shifter, the input and output circulating devices of the subject invention are realized through the combination of a longitudinally magnetized Faraday rotator 108,110 and a septum polarizer 104,106 rather than through a single (quadrapole) transversely magnetized nonreciprocal polarizer as in a conventional dual mode phase shifter.

Prior to a discussion of the operation of the subject invention, each of the components shown in the exploded view in FIG. 10*b* will be described in detail in conjunction with individual drawings associated therewith employing common reference numerals.

The Twin-Slab, Nonreciprocal Phase Shifters

The phase shifters employed may be, for example, those shown in FIGS. 4*a* and 4*b*. Although later illustrations show a dual-toroid, minor loop switched version of the twin-slab phase shifter in which the waveguide housing 101 is formed by metallizing the outer surface of the ferrite dielectric assembly, other realizations of the twin-slab phase shifter (i.e. single-toroid phase shifters, twin-slab phase shifters in conventional machined waveguide housings, multi-bit phase shifters, etc.) are equally applicable.

The Septum Polarizer

Figure 12A:
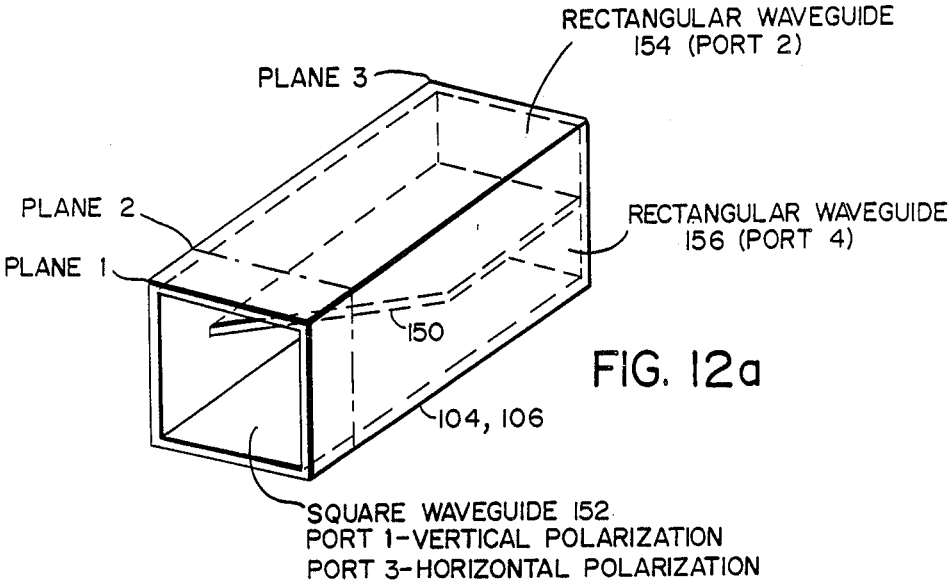
FIG. 12*a* shows a common wall septum polarizer and FIGS. 12*b* through 12*d* illustrate the operation of the septum polarizer of FIG. 12*a* when vertically and horizontally polarized waves enter the polarizer.
Figures 12B, 12C, 12D:
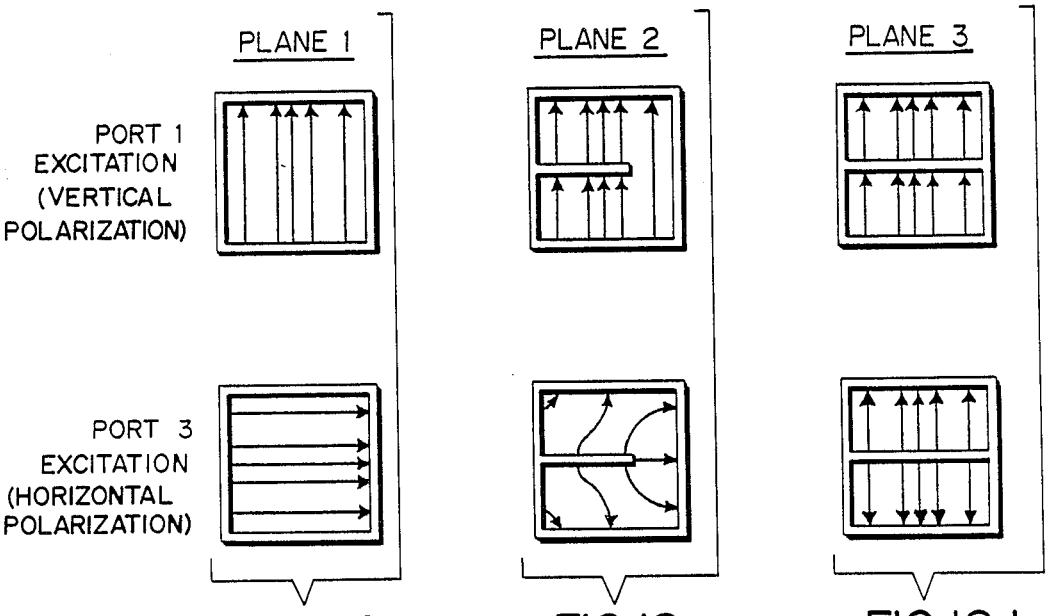

As shown in FIG. 12*a*, (reciprocal) septum polarizers 104, 106 serve to couple two rectangular waveguides 154, 156 (each propagating the $TE_{10}$ mode) with a single square waveguide 152 having two propagating modes (which may be defined as the $TE_{10}$ and $TE_{01}$ modes or two linear combinations of these modes which are selected to be orthogonal to each other). Since the two modes propagating in the square waveguide 152 are orthogonal, the device is a four-port network with (for instance) port 1 being vertical polarization ($TE_{10}$)in the square waveguide 152, port 3 being horizontal polarization $TE_{01}$) in the square waveguide 152, and ports 2 and 4 being the two rectangular waveguide ports 154, 156.

The operation of the common wall septum polarizer 104, 106 is as illustrated in FIGS. 12*a–d*. In this case, the septum itself has been shown as tapering linearly; however, other realizations in which the taper 150 is nonlinear or a combination of discrete steps are also possible. As can be seen from the top portion of FIGS. 12B–12D, if a vertically polarized wave enters the square waveguide 152 (excitation of port 1), waves of equal magnitude and phase will be delivered to the two rectangular ports 154, 156 (equal signals emerging from ports 2 and 4). On the other hand, as shown in the bottom portion of 12B–12D, a horizontally polarized wave applied to the square waveguide 152 (excitation of port 3) will produce waves equal in magnitude but opposite in phase at the two rectangular waveguide ports 154, 156 (out-of-phase coupling to ports 2 and 4). Thus, the septum polarizer performs identically to a magic tee with vertical polarization at the input being equivalent to the sum port, horizontal polarization at the input equivalent to the difference port, and the two (rectangular waveguide) outputs being analogous to the colinear ports of the magic tee. If the device is symmetrical and impedance matched, then its scattering matrix will be that shown below.

$$[S] = \frac{1}{\sqrt{2}} \begin{bmatrix} 0 & e^{j\phi 1} & 0 & e^{j\phi 1} \\ e^{j\phi 1} & 0 & e^{j\phi 2} & 0 \\ 0 & e^{j\phi 2} & 0 & -e^{j\phi 2} \\ e^{j\phi 1} & 0 & e^{j\phi 2} & 0 \end{bmatrix} \quad (1)$$

As can be seen, the insertion phase from vertical polarization in the square waveguide 152 to either the rectangular waveguide ports 154, 156 is, in general, different than that from horizontal polarization to the rectangular waveguide ports 154, 156 due to the operation of the polarizer itself (although the possibility of designing the polarizer so that these two phases would be identical is not necessarily excluded). It is, however, possible to add insertion phase trimming devices (such as thin vertical or horizontal polarized dielectric vanes) in the square waveguide 152 which will make $\phi 1$ equal to $\phi 2$ at least over a limited range of frequencies. If this is accomplished, then the scattering matrix becomes that shown below.

$$[S] = \frac{1}{\sqrt{2}} \begin{bmatrix} 0 & e^{j\phi} & 0 & e^{j\phi} \\ e^{j\phi} & 0 & e^{j\phi} & 0 \\ 0 & e^{j\phi} & 0 & -e^{j\phi} \\ e^{j\phi} & 0 & e^{j\phi} & 0 \end{bmatrix} \quad (2)$$

As was discussed above, the excitation of the square waveguide 152 may be defined as a combination of any two orthogonal modes propagating through this structure. If these modes are chosen to be slant 45∼ right ($TE_{10}+TE_{01}$) and slant 45∼ left ($TE_{10}-TE_{01}$) ports 1 and 3 will be re-defined. If phase matching (such as was necessary to arrive at equation [2] above) has been accomplished then the septum polarizer will operate as is shown in FIGS. 13A–D and have the scattering matrix shown below.

$$[S] = \frac{1}{\sqrt{2}} \begin{bmatrix} 0 & e^{j\phi} & 0 & 0 \\ e^{j\phi} & 0 & 0 & 0 \\ 0 & 0 & 0 & e^{j\phi} \\ 0 & 0 & e^{j\phi} & 0 \end{bmatrix} \quad (3)$$

Figure 13A:
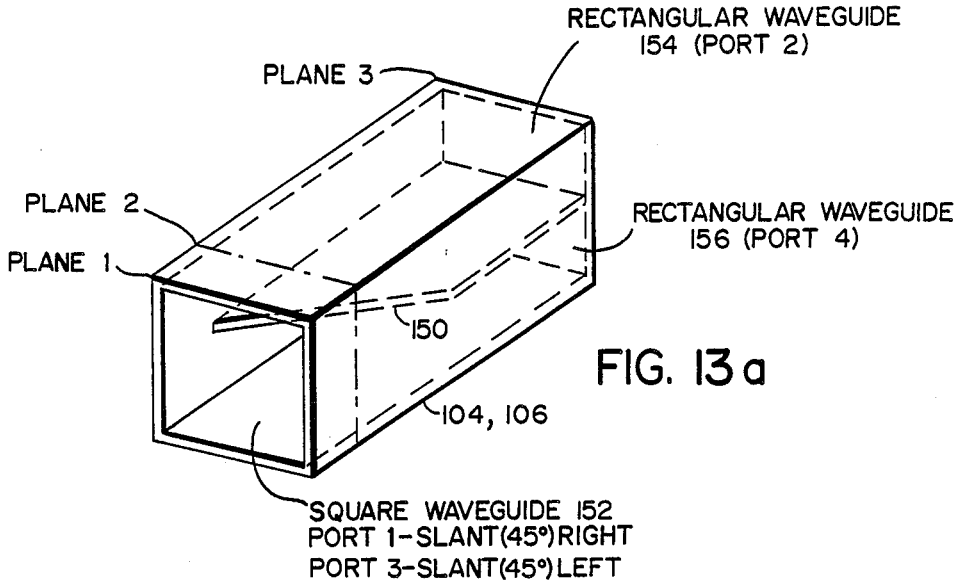
FIG. 13*a* shows a common wall septum polarizer and FIGS. 13*b* through 13*d* show the operation of the polarizer of FIG. 13*a* when slant right and slant left polarized waves enter the polarizer.
Figures 13B, 13C, 13D:
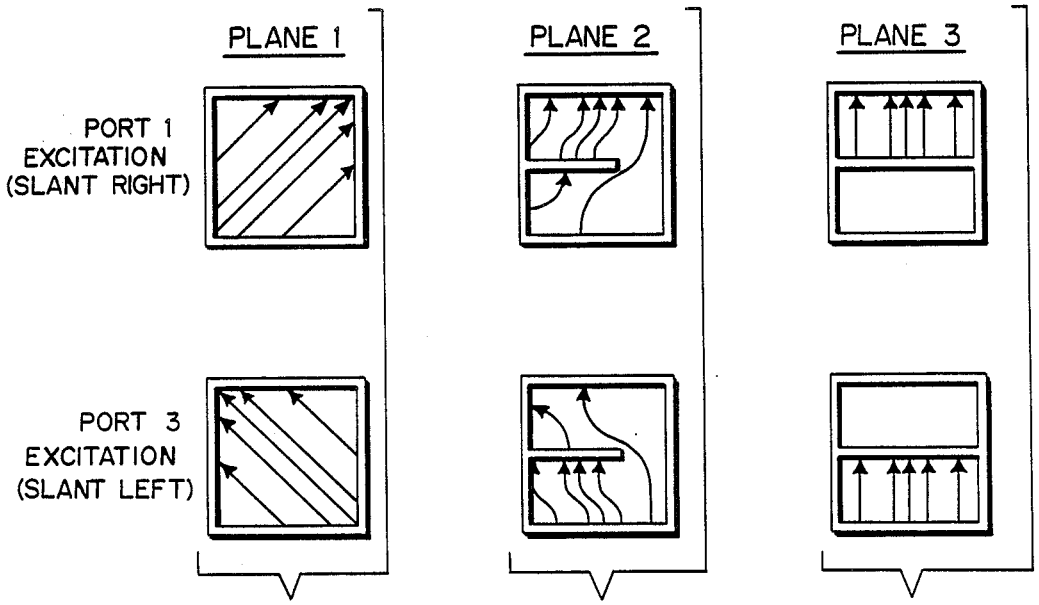

Although these characteristics are not intuitively obvious from FIG. 13, they can be arrived at through superposition either by considering the scattering matrix itself or the illustration of the fields presented in FIGS. 13*b–d*. FIG. 13A is identical to FIG. 12A and is identically labelled. FIGS. 13*b–d* demonstrate how the septum polarizers 104, 106 respond to slant right and slant left excitations to route the input signal to port 2 and 3, respectively, while shifting the signal polarization to vertical polarization.

Figure 14:
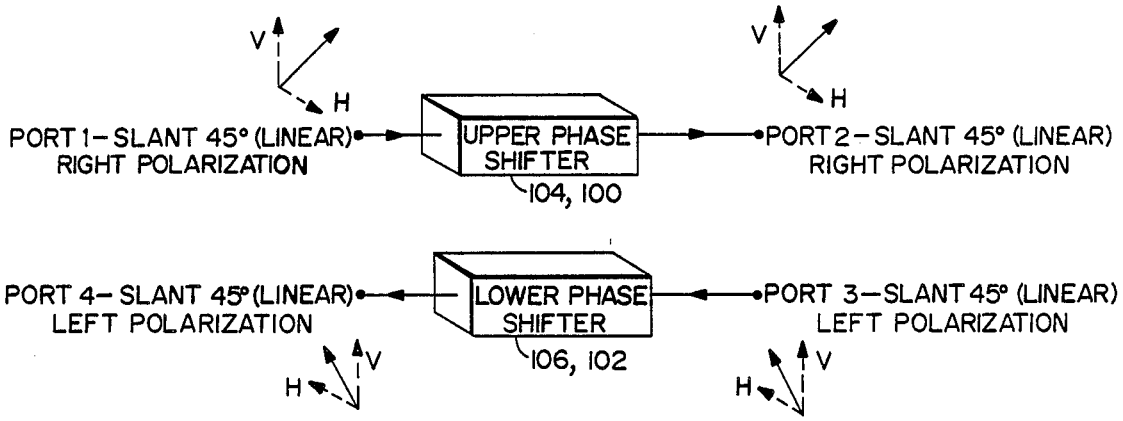
FIG. 14 shows an equivalent circuit of an inner portion of the structure shown in FIG. 10.

Assuming the choice of slant right and slant left as the excitations of the square waveguide portion 152 of the septum polarizers 104,106, an equivalent circuit formed by two septum polarizers 104,106 in conjunction with two phase shifters 100, 102 (the inner portion of the pseudoreciprocal phase shifter shown in FIG. 10) is illustrated in FIG. 14. That is, all of the signal incident upon port 1 will be routed through the upper phase shifter 104, 100 only and delivered to port 2. Equivalently, all of the signal delivered to port 3 will be routed through the lower phase shifter 102, 106 and arrive at port 4.

The Faraday Rotator

The operation of the Faraday rotators 108, 110, which is illustrated in FIGS. 15A and B depends upon the Faraday rotation effect by which the polarization of electromagnetic wave propagating in a longitudinally magnetized ferrite rod 170 will rotate as the wave progresses. A circular or square waveguide 172 is generally used with a smaller ferrite rod whose axis coincides with the axis of the waveguide although fully ferrite filled versions are possible. A typical realization is illustrated in FIGS. 15*a* and 15*b*. As can be seen in FIG. 15A, an incident wave upon port 1 and propagating from left to right, whose electric field is vertically polarized will be rotated through an angle $\theta°$. As shown in FIG. 15*b*, a wave propagating in the opposite direction will also be rotated through $\theta°$ but in the same direction. Thus, a vertically polarized wave applied to port 1 might rotate to an angle 45° removed from vertical when passing through the device but due to the nonreciprocal properties, an identically polarized wave (45° removed from vertical) reflected back to enter port 2 of the device (propagating right to left) would not be restored to the initial vertical polarization. Instead, it would continue to rotate in the same sense as before, emerging from the input as a horizontally polarized signal.

Polarization Selectors

The polarization selector 112 or 114 shown at either end of the assembly illustrated, in FIG. 10 is simply a resistive vane 113 or 115, respectively whose plane is oriented perpendicular to the E-field of the desired electromagnetic wave emerging from the phase shifting assembly. Since these vanes are thin and lie in a plane perpendicular to the E-field of the vertically polarized wave, the desired waves will be transmitted with little attenuation. Undesired signals whose electric fields are oriented parallel to the plane of the resistive vane 113 will be almost completely absorbed if the design of this vane (resistivity and physical dimensions) is properly chosen. In principle, if all of the other components (in particular the Faraday rotators 108, 110 and the septum polarizers 104, 106) perform perfectly, the polarizer selectors 112, 114 would not be required; however, experience indicates that such perfection will not be achieved and these vanes are desirable to prevent degraded performance under certain conditions of operation.

Fast Switching Pseudoreciprocal PhaseShifter

With Co-Polarized Input And Output Waveguides

Figure 16A:
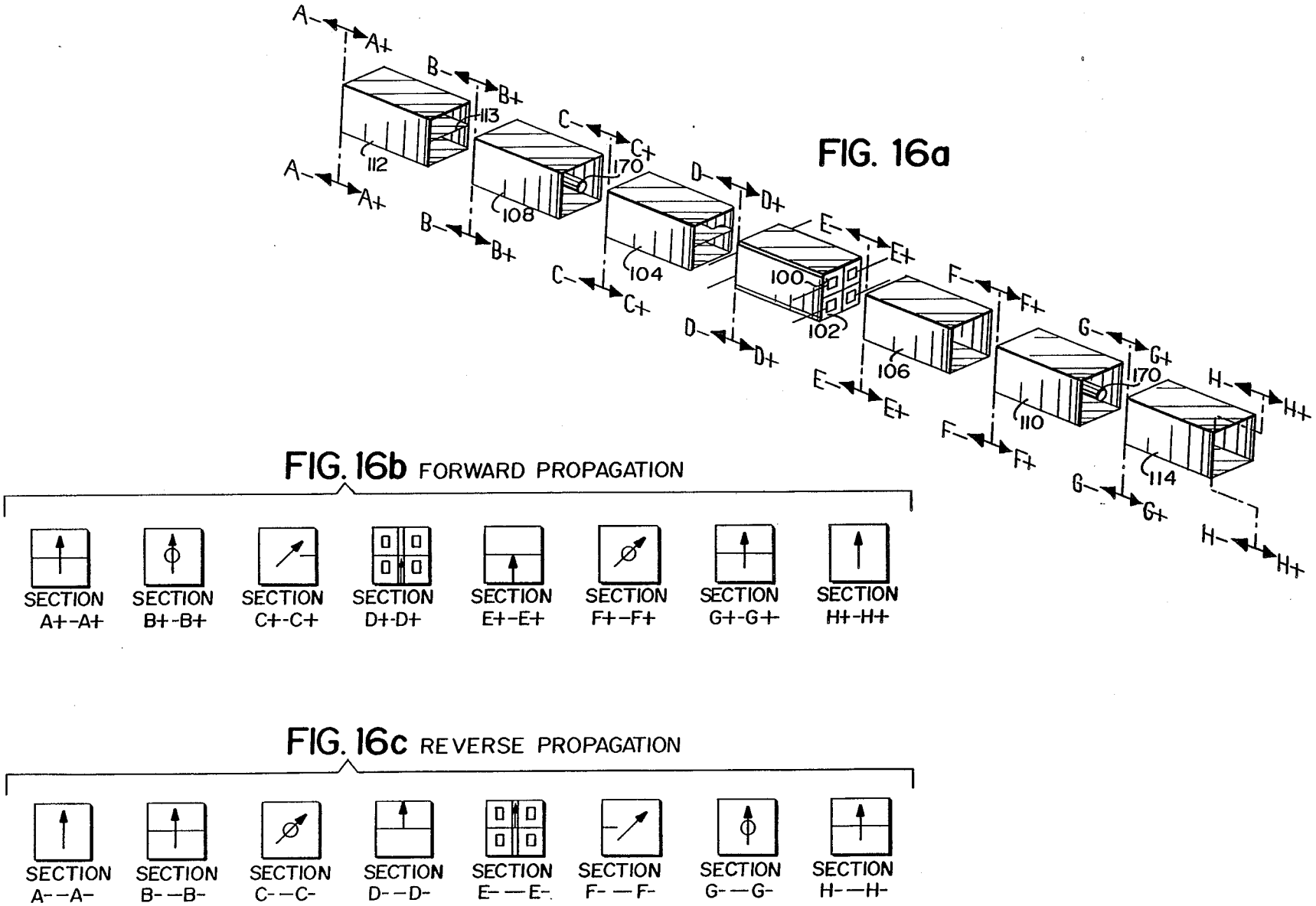
FIG. 16*a* shows an exploded view of the fast switching phase shifter of FIG. 10 and FIGS. 16*b* and 16*c* indicate the polarization of the E field at various points throughout the structure of FIG. 16*a* for forward propogation and reverse propagation, respectively.

As indicaed in regard to FIG. 10, this structure is comprised of two twin-slab non-reciprocal phase shifters 100, 102 which share common waveguide wall 103, two septum polarizers 104, 106, two Faraday rotators 108, 110, and two absorptive vane polarization selectors 112, 114 interconnected as is illustrated in FIG. 16A. The combination of a septum polarizer and Faraday rotator 108 functions as a nonreciprocal four-port circulator yielding the equivalent circuit of FIG. 11 wherein a wave entering at port 1 is routed through phase shifter 1 and then directly to the output at port 2. A signal entering at port 2 is routed through phase shifter 2 and then to the output at port 1.

The operation of the assembly can be understood by examining FIGS. 16*b* and 16*c*, which shows how the polarization of the E-field changes as the wave passes through each component. For forward propagation (left to right) a vertically polarized signal enters the polarization selector 112 at Section A+—A+. Since it is perpendicular to the resistive vane 113, it passes essentially unattenuated through this section to the entrance to the Faraday rotator 108 (Section B+—B+). The Faraday rotator 108 is magnetized so that the polarization of the E-field will be rotated by ferrite rod 170 through 45° and, consequently, a slant-45°-right polarized wave will be delivered at the input of the septum polarizer 104 (Section C+—C+). As can be understood from FIG. 13, the septum polarizer 104 will deliver all of the energy contained in such a wave to the lower waveguide at its output (Section D+—D+) which leads directly to the lower phase shifter 102. Emerging from the phase shifter 102 (Section E+—E+) the wave is converted to slant-45°-right polarization at the input to the Faraday rotator 110 (Section F+—F+) rotated 45° counterclockwise to yield a vertically polarized signal at the entrance to the polarization selector 14 (Section G+—G+) and then delivered essentially unattenuated with vertical polarization to the output of the phase shifter assembly (Section H+—H+). Any horizontal component of the wave which might be created due to imperfections in the Faraday rotators 108, 110 or septum polarizers 104, 106 will be absorbed by the resistive vane 113 within the polarization selector.

Operation for a reverse propagating signal (right to left) proceeds in similar manner as is shown in Sections H−—H− through A−—A−. One should note, of course, that the non-reciprocal nature of the Faraday rotators 108, 110 will reverse the direction of rotation produced (right hand rotation becomes left hand rotation and vice versa when the direction of propagation is reversed).

Phase shifters 100 and 102 are switched to remanent states which are equal in magnitude but opposite in sense and, as a result, waves propagating in either direction are given identical phase shift. The insertion phase of the fast switching phase shifting assembly is modified by simultaneously switching the upper and lower phase shifters to new states which are again equal in magnitude but opposite in sense so that the phase shift provided by the assembly maintains reciprocal properties.

Although this structure shows square waveguides being used in the polarization selectors 112,114, Faraday rotators 108, 110, and septum polarizers 104, 106, it is contemplated by the present invention that other dual-mode waveguide configurations (e.g., circular waveguide and cruciform quadridge waveguide, etc.) may alternatively be utilized.

If the magnetization of the output Faraday rotator 110 is reversed and the orientation of the output polarization selector 114 is physically rotated through 90° about its longitudinal axis, the structure will be modified so that port 2 in FIG. 10 comprises horizontal rather than vertical polarization. This phase shifting structure will perform identically with that described above excepting that its input and output ports will be rotated 90° with respect to each other.

In certain applications it may be desirable that the forward and reverse propagating waves receive different phase shifts. For example, in an electronically scanned antenna (e.g., phased array antenna), a broad beam might be desired for transmit and a pencil beam for receive. The structure of FIG. 16 allows such an operation to be achieved if the upper and lower phase shifters are controlled by separate electronic drivers and set to separate phase shift states.

Miniature, Duplexing Pseudoreciprocal Phase Shifter

Figure 17A:
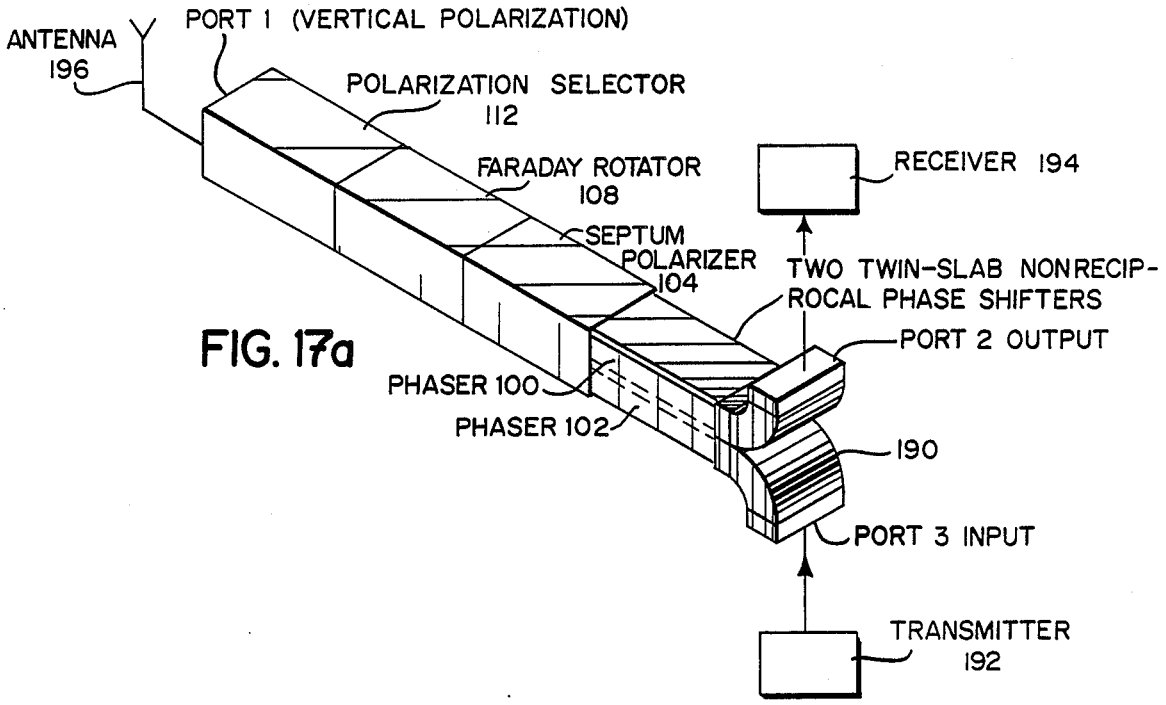
FIG. 17*a* illustrates the construction of a miniature, duplexing, pseudoreciprocal phase shifter
Figure 17B:
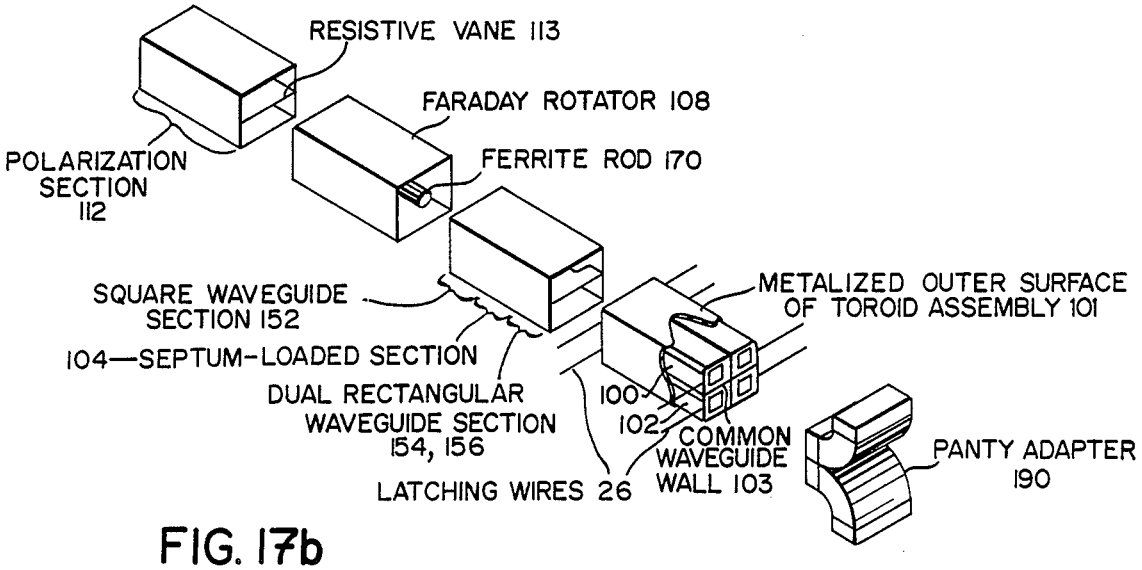
FIG. 17*b* shows a exploded view of a portion of the structure shown in FIG. 17*a;*

If the output septum polarizer 106, Faraday rotator 110, and polarization selector 114 (those components closest to port 2) are removed from the structure of FIG. 10 and replaced by a panty adapter 190, or similar structure, the structure of FIGS. 17A and 17B is realized. As can be seen from this figure and the equivalent circuit of FIG. 18, this structure has advantages previously cited for that of FIG. 10 while also performing the operation of duplexing. For example, as generally represented in FIG. 17A, a transmitter 192 may be connected to port 3, an antenna 196 connected to port 1, and a receiver 194 to port 2.

Figure 18:
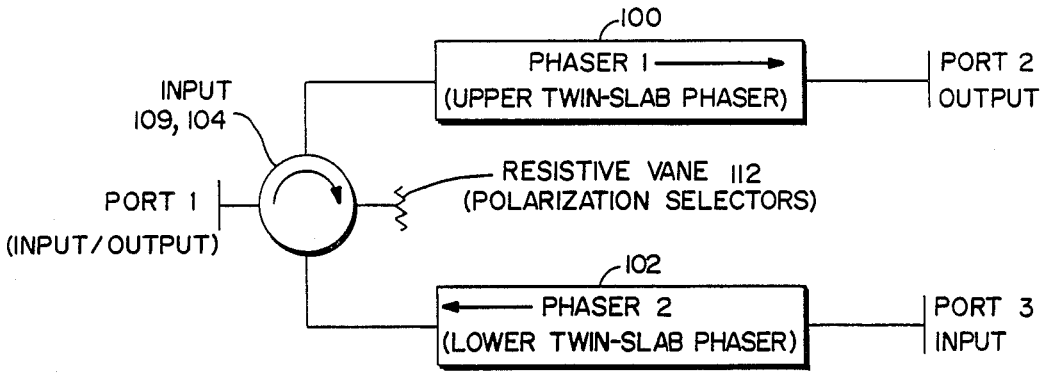
FIG. 18 is an equivalent circuit of the phase shifting duplexing structure shown in FIG. 17*a*.
Figure 19A:
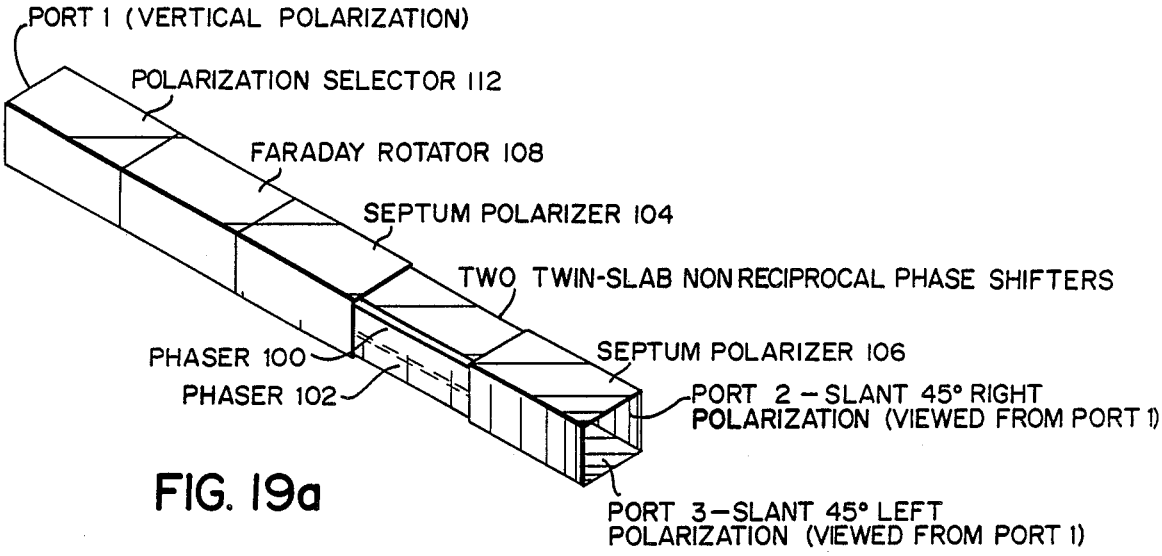
FIG. 19*a* is an alternative embodiment of the miniature duplexing pseudo reciprocal phase shifter and FIG. 19*b* is an exploded view thereof.
Figure 19B:
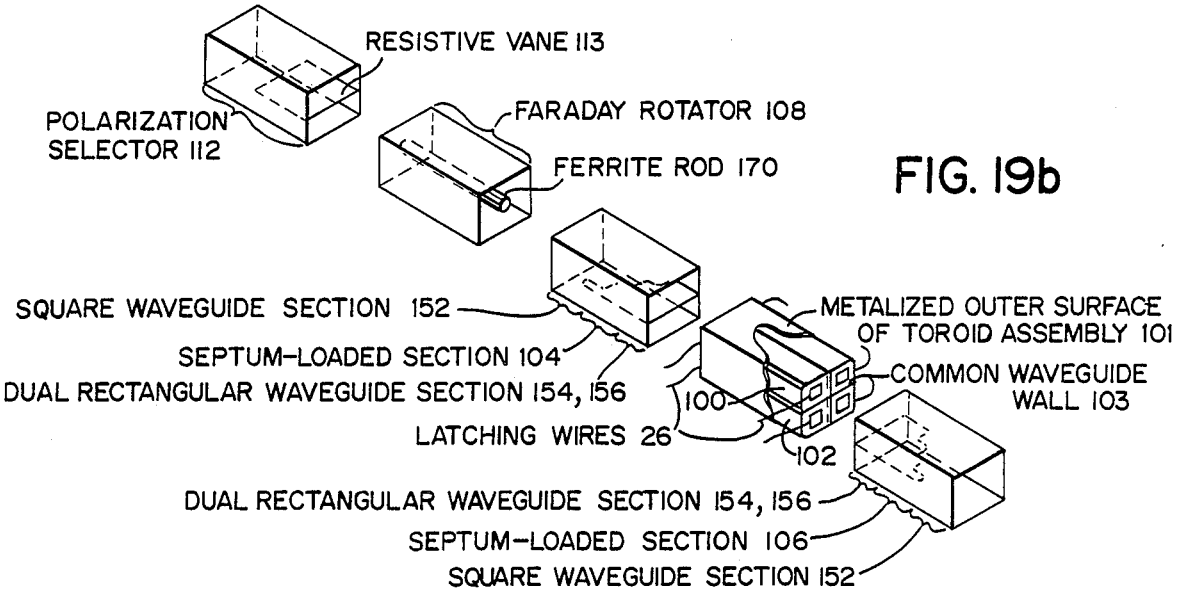

The equivalent circuit of FIG. 18 can also be realized by the structure shown FIGS. **19*a* and 19*b*. This device is also a modification of the basic fast switching pseudoreciprocal phase shifter of FIG. 10. In this case, the output polarization selector 114 and Faraday rotator 110 have been removed but the output septum polarizer 106 remains. If the structure is otherwise identical to that of FIG. 10, a wave applied to port 1 shown in FIG. 19A will pass through the lower twin slab phase shifter 102 and be delivered at the output of the septum polarizer 106 with a linear polarization rotated 45° to the right of vertical when viewed in the direction of propagation (from port 1). Similarly, a linearly polarized signal entering this same septum polarizer 106 from the opposite direction whose polarization is orthogonal to that just described (45° to the right of vertical when viewed from the direction of propagation or 45° to the left of vertical when viewed from port 1) will be routed through the upper phase shifter 100 and delivered to port 1. Since these two "slant" polarizations are orthogonal to each other, they may be considered independent ports and, consequently, the equivalent circuit of FIG. 18** results.

This particular structure may be utilized with a dual-polarized radiating element (at the end corresponding to port 2 and port 3) in a space-fed phased array. In this case, port 1 would transmit to and receive signals from free space while port 2 would deliver signals to and port 3 receive signals from the space feed. A dual-polarized antenna with separate polarization outputs (for example a dual-polarized horn attached to an orthogonal mode transducer) would be used at the other end of the space feed to separate signals having orthogonal polarizations into the transmitter and receiver paths.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fast switching phase shifter comprising:

a first input/output means for receiving forward and reverse propagating electromagnetic waves;

a waveguide coupled to said first input/output means;

aplurality of non-reciprocal phase shifters enclosed entirely within said waveguide, each of said phase shifters including a toroidal element; and a second input/output means coupled to said waveguide for receiving forward and reverse propagating electromagnetic waves;

said first input/output means being operatively coupled to route forward propagating electromagnetic waves only to one of said phase shifters and to receive reverse propagating electromagnetic waves only from another one of said phase shifters and said second input/output means being operatively coupled to route reverse propagating electromagnetic waves only to said another one of said phase shifters and to receive rorward propagating electromagnetic waves only from said one of said plurality of phase shifters.

2. A fast switching phase shifter according to claim 1, wherein said first and second input/output means include a longitudinally magnetized Faraday rotator and a septum polarizer.

3. A fast switching phase shifter according to claim 2, wherein said septum polarizer includes a square waveguide on one end and two rectangular waveguides on its other end and wherein said plurality of phase shifters are enclosed within rectangular waveguides, said septum polarizer including means for coupling its two rectangular waveguides with the rectangular waveguides enclosing said plurality of phase shifters.

4. A fast switching phase shifter according to claim 3, wherein said septum polarizer includes a tapered common wall.

5. A fast switching phase shifter according to claim 3, wherein said septum polarizer includes a stepped common wall.

6. A fast switching phase shifter according to claim 1, wherein said first input/output means includes input circulating means responsive to a forward propagating input electromagnetic signal of a first predetermined orientation to couple said forward propagating signal to one of said phase shifters and said second input/output means includes input circulating means responsive to a reverse propagating signal having a second predetermined orientation to couple said reverse propagating signal to another one of said phase shifters.

7. A fast switching phase shifter according to claim 6, wherein each of said input circulating means includes waveguide means operatively coupled to said phase shifters and including polarization rotating means disposed within said waveguide means for receiving an input electromagnetic wave and for rotating its polarization as the electomagnetic wave propogates therethrough.

8. A fast switching phase shifter according to claim 7, wherein said polarization rotating means includes a longitudinally magnetized ferrite rod mounted along the axis of said waveguide.

9. A phase shifter according to claim 1, further including means coupled to said first and second input/output means for passing signals of a predetermined polarization and for attenuating signals not having said predetermined polarization.

10. A fast switching phase shifter according to claim 1, further including a first port coupled to said first input/output means, and second and third ports coupled to said second input/output means.

11. A fast switching phase shifter according to claim 10, further including an antenna coupled to said first port, transmitting means coupled to said second port for generating signals to be transmitted via said antenna, and receiving means coupled to said third port for receiving signals received by said antenna.

12. A fast switching phase shifter comprising:

input/output polarization selector means for receiving forward and reverse propagating electromagnetic waves and for passing electromagnetic waves having a predetermined polarization;

polarization rotation means coupled to said input/output polarization selector means for rotating the polarization of a received electromagnetic wave to generate a rotated polarized electromagnetic wave;

first and second non-reciprocal phase shifters disposed within a waveguide so as to form two parallel signal paths, said first and second non-reciprocal phase shifters each including toroidal elements which do not intersect any wall of said waveguide;

means for coupling said rotated polarized electromagnetic wave to at least one of said first and second phase shifters for routing forward propagating electromagnetic waves to one of said parallel signal paths and reverse propagating electromagnetic waves to another of said parallel paths.

13. A fast switching phase shifter according to claim 12, wherein said input/output polarization selector means includes first and second selector means for receiving signals propagating in the forward and reverse directions;

and wherein said means for coupling includes a first means responsive to a forward propagating signal for coupling said forward propagating signal to said first phase shifter and second means responsive to a reverse propagating signal for coupling said reverse propagating signal to said second phase shifter.

14. A fast switching phase shifter according to claim 12, wherein said first and second phase shifters are twin-slab nonreciprocal phase shifters disposed entirely within a common dual-waveguide housing.

15. A fast switching phase shifter according to claim 12, wherein said first and second phase shifters are twin-slab nonreciprocal phase shifters disposed entirely within two single waveguide housings.

16. A fast switching phase shifter according to claim 14, wherein each of said phase shifters include latching means for controlling the magnetization of said toroidal elements, and wherein each of said phase shifters are switched via said latching means to separate magnetization states so as to provide identical phase shifts for waves propagating in either the forward or reverse directions.

17. A fast switching phase shifter according to claim 14, wherein each of said phase shifters include latching means for controlling the magnetization of said toroidal elements, and wherein each of said phase shifters are switched via said latching means to separate magnetization states so as to provide individually controllable phase shifts for waves propagating in either the forward or reverse directions.

18. A fast switching phase shifter according to claim 12, wherein said input/output polarization selector means comprises first and second polarization selectors disposed at opposite ends of the phase shifter each capable of performing as an input port and an output port.

19. A fast switching phase shifter according to claim 18, wherein said first and second polarization selectors includes a resistive vane.

20. A fast switching phase shifter according to claim 19, wherein said resistive vane lies in a plane perpendicular to the E field of a vertically polarized wave.

21. A fast switching phase shifter according to claim 12, wherein said polarization rotation means include first and second polarization rotators each coupled to said first and second phase shifters via said means for coupling.

22. A fast switching phase shifter according to claim 21, wherein said first and second polarization rotators each comprise a Faraday rotator.

23. A fast switching phase shifter according to claim 12, wherein said means for coupling comprise first and second coupling means, each coupled to both said first and second non-reciprocal phase shifters.

24. A fast switching phase shifter according to claim 23, wherein said first and second coupling means comprise septum polarizers.

25. A fast switching phase shifter according to claim 18, wherein said fast switching phase shifter includes at least one input port and at least one output port and wherein said polarization rotation means includes first and second polarization rotators ad wherein said first and second polarization rotators are magnetized such that signals entering an input port and exiting an output port are identical in phase.

26. A fast switching phase shifter according to claim 18, wherein said polarization rotation means includes first and second polarization rotators which are magnetized such that forward and reverse propagating waves receive individually controllable phase shifts.

27. A method for rapidly switching and reciprocally operating a phase shifter having first and second latching toroidal non-reciprocal phase shifters, each of said non-reciprocal phase shifters having at least one toroidal element, said method comprising the steps of:

switching said toroidal elements from one magnetization state to another magnetization state such that there is no break in the magnetic switching path and no associated eddy current switching delay;

routing a forward propagating transmitted signal only through said first latching toroidal non-reciprocal phase shifter; and routing a reverse propagating received signal only through a second latching toroidal nonreciprocal phase shifter.

28. A method according to claim 27, further including the steps of disposing said first and second latching toroidal nonreciprocal phase shifters entirely within a common dual-waveguide housing.

29. A method according to claim 27, further including the steps of disposing said first and second latching toroidal nonreciprocal phase shifters entirely within two single waveguide housings.

30. A method according to claim 27, wherein said switching step includes the step of switching each of said nonreciprocal phase shifters via a latching means to remanent magnetization states to provide identical phase shifts for waves propagating in either the forward or reverse directions.

31. A method according to claim 27, wherein said switching step includes the step of switching each of said nonreciprocal phase shifters via a latching means to remanent magnetization states to provide individually controllable phase shifts for waves propagating in either the forward or reverse directions.

32. A method according to claim 27, wherein said routing step includes the step of routing a forward propagating transmitted electromagnetic wave and a reverse propagating received electromagnetic wave through first and second Faraday rotators.

33. A method according to claim 32, wherein said routing step further includes the step of routing a forward propagating transmitted electromagnetic wave and a reverse propagating received electromagnetic through first and second septum polarizers respectively coupled to said first and second Faraday rotators.

34. A method according to claim 27, wherein said switching step includes the step of switching the first and second non-reciprocal phase shifters to remanent states which are equal in magnitude but opposite in sense so that waves propagating in forward and reverse directions are given identical phase shifts.

35. A method according to claim 27, wherein said switching step includes the step of switching the first and second non-reciprocal phase shifters to separate magnetization states such that waves propagating in forward and reverse directions are given individually controllable phase shifts.

* * * * *

UNITED STATES PATENT AND TRADEMARK OFFICE

CERTIFICATE OF CORRECTION

PATENT NO. : 4,884,045

DATED : November 28, 1989

INVENTOR(S) : William K. Alverson and James A. Fuller

It is certified that error appears in the above-identified patent and that said Letters Patent is hereby corrected as shown below:

On the title page:

In the listing of the Inventors' name and Residence: Please delete "Ruller" and insert --Fuller--; delete "Decature" and insert --Decatur--.

Signed and Sealed this

Ninth Day of October, 1990

*Attest:*

HARRY F. MANBECK, JR.

*Attesting Officer*

*Commissioner of Patents and Trademarks*